US006442869B2

(12) United States Patent
Coomes

(10) Patent No.: US 6,442,869 B2
(45) **Date of Patent: *Sep. 3, 2002**

(54) CHILDREN'S SANDALS HAVING REPLACEABLE SOLES

(76) Inventor: Mark A. Coomes, 3854 Open Creek Ct., Jacksonville, FL (US) 32224

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/513,866

(22) Filed: Feb. 28, 2000

(51) Int. Cl.[7] ..... A43B 3/12

(52) U.S. Cl. ..... 36/11.5; 36/15; 36/100; 36/112; D2/916; D2/976; D2/897

(58) Field of Search ..... 36/112, 15, 100, 36/101, 11.5, 12, 31, 136, 132, 7.5, 7.6, 1, 30 R, 25 R; D2/952, 951, 948, 897, 976, 916

(56) References Cited

U.S. PATENT DOCUMENTS

| | | | | | |
|---|---|---|---|---|---|
| D77,932 | S | * | 3/1929 | Blum | 36/112 |
| 1,823,634 | A | * | 9/1931 | Wiesner | 36/112 |
| 3,538,628 | A | * | 11/1970 | Einstein, Jr. | 36/15 |
| 4,050,167 | A | * | 9/1977 | Senter | 36/32 R |
| 4,050,168 | A | * | 9/1977 | Pace | 36/136 |
| D260,447 | S | * | 9/1981 | Greenblatt et al. | 36/112 |
| 4,525,940 | A | * | 7/1985 | Mochizuki | 36/8.1 |
| 5,836,090 | A | * | 11/1998 | Smith | 36/15 |
| 5,979,085 | A | * | 11/1999 | Ross et al. | 36/136 |
| 5,980,351 | A | * | 11/1999 | McCook | 446/26 |

OTHER PUBLICATIONS

American Shoemaking Article, Oct. 1940.*

* cited by examiner

*Primary Examiner*—Mickey Yu
*Assistant Examiner*—Jila Mohandesi
(74) *Attorney, Agent, or Firm*—Thomas L. Moses

(57) ABSTRACT

A child's sandal, having removable and interchangeable soles that may be attached to a permanent upper sole, where the bottom of the removable soles has any desired textured graphical design, such as an animal paw print or the like. A removable ornamental design may be added to an upper portion of the sandal, on top of a wearer's foot, to correspond to the underside of the removable sole. For instance, if the underside of the removable sole includes a design that resembles a bear claw track, then the removable ornamental design may resemble a bear's face and head. Similarly, if the underside of the removable sole resembles the footprint of a rabbit's foot, then the removable ornamental design may resemble a rabbit's face, head, and ears. This arrangement allows a child to choose from any number of available soles and ornamental designs to be attached to a single pair of sandals or flip-flops. The designs on the underside of the removable soles are formed and shaped so that a child walking on a soft surface would leave footprints similar to the sole design. The removable soles may be attached to the underside of the upper sole by using hook and loop fasteners, threaded screw members, snaps, or any other suitable means. Similarly, the ornamental design members may be attached to the upper portion of the sandals by snaps, hook and loop fasteners, or any other suitable means.

6 Claims, 3 Drawing Sheets

FIG. 1
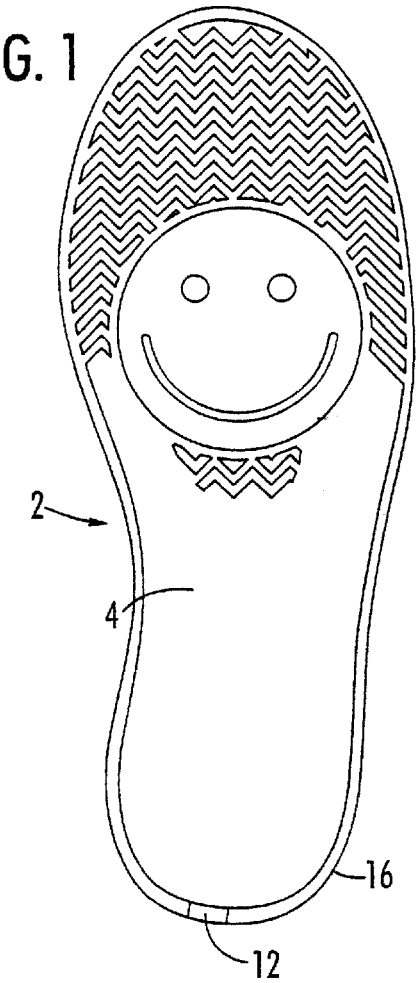
FIG. 1A
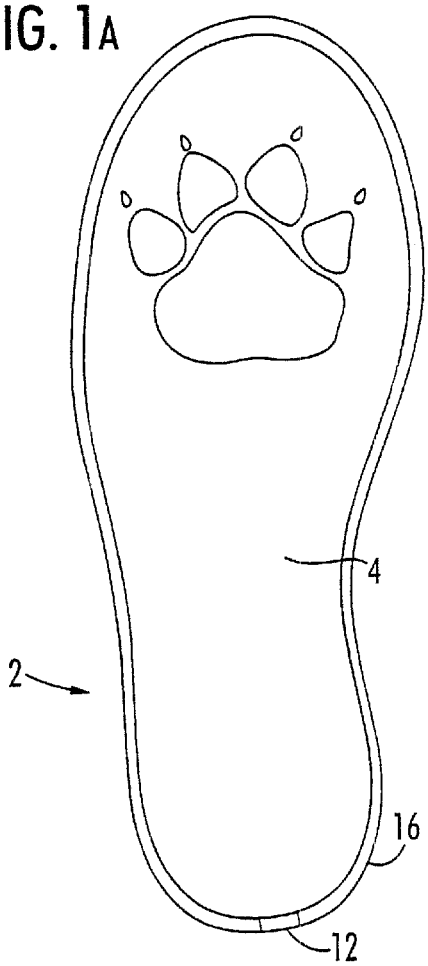
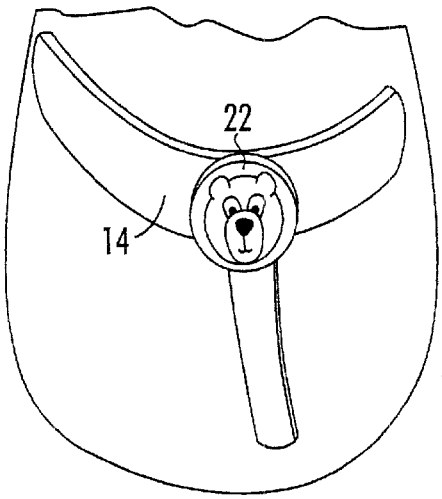
FIG. 1B

CHILDREN'S SANDALS HAVING REPLACEABLE SOLES

BACKGROUND OF THE INVENTION

1. Field of the Invention

The invention described and claimed herein relates generally to sandals and flip-flop types of footwear. More specifically, the present invention includes a child's sandal, having removable and interchangeable soles that may be attached to a permanent upper sole, where the removable soles have any desired graphical design, such as an animal paw print or the like. A removable ornamental design may be added to an upper portion of the sandal, on top of a wearer's foot, to correspond to the underside of the removable sole. For instance, if the underside of the removable sole includes a design that resembles a bear claw track, then the removable ornamental design may resemble a bear's face and head. Similarly, if the underside of the removable sole resembles the footprint of a rabbit's foot, then the removable ornamental design may resemble a rabbit's face, head, and ears.

This arrangement would allow a child to choose from any number of available soles and ornamental designs to be attached to a single pair of sandals or flip-flops. The designs on the underside of the removable soles would be formed and shaped so that a child walking on a soft surface would leave footprints similar to the sole design. The removable soles may be attached to the underside of the upper sole by using hook and loop fasteners, threaded screw members, snaps, or any other suitable means. Similarly, the ornamental design members may be attached to the upper portion of the sandals by snaps, hook and loop fasteners, or any other suitable means.

2. Discussion of the Prior Art

U.S. Pat. No. 4,062,132, issued to Klimaszewski, discloses footwear having a body portion receptive of a person's foot during use and a replaceable tread portion. The tread portion is releasably locked into the body portion by a flange having gripping members on the inner peripheral surface. The tread portion has a hollowed top portion having an outer peripheral surface with gripping apertures therein in which the gripping members are received. The outer peripheral surface of the hollowed top portion is closely received in the flange and the tread portion is thus prevented from moving both laterally and perpendicularly thereby.

U.S. Pat. No. 4,267,650, issued to Bauer, teaches athletic shoes with removable outsoles. Each upper is designed to fit an individual foot and ankle for a particular wearer and such upper is provided with an insole securely and permanently connected therewith. Each insole terminates along its peripheral margin with one part of a bead-and-recess mechanically detachable locking member. A removable outsole is provided with a surface contacting tread which is selected to not only best match the surface of a particular sports area but also the condition of such surface at a particular time of use. A flexible member is permanently connected with the outsole and terminates along its peripheral margin with the other part of the mechanical locking member. The outsole and the insole are further connected together by mating Velcro members, tongues and grooves carried by the outsole and insole in paired relations, and other interlocking means.

U.S. Pat. No. 4,317,294, issued to Goodyear, shows a replaceable shoe sole comprising a mid-sole, which is securely attached to the upper portion of the shoe, and an outsole removably attached to the midsole. The upper surface of the outsole is provided with a continuous ridge which is snapped into a matching, deformably resilient groove recessed into the bottom surface of the midsole. The configuration of the ridge and the resiliency of the outsole and the midsole material, which is preferably a polyurethane resin or foam, permits the outsole to be easily and selectively removed and replaced by an outsole having a new or distinctive tread pattern, the replaced outsole being reusable if desired. The ridge on the outsole is provided with an undercut portion to provide secure retention of the outsole in the midsole, although the specific cross sectional shape of the ridge may vary depending upon the retentiveness required by a particular activity.

U.S. Pat. No. 4,936,028, issued to Posacki, discloses a shoe with replaceable outsole, destined for use as a tourist, army, work, etc. shoe. It is basically comprised of an upper portion to which the upper sole is permanently attached in some manner, a removable outsole with an interlocking feature on top which engages with the bottom of the uppersole and with a varying bottom portion (depending on the use it is put to), and a removable set of connector rods.

None of the prior art, however, discloses a child's sandal having a removable sole member that includes a desirable graphical portion formed on a bottom thereof, such as a bear claw track or the like, together with a removable ornamental design member that may be removably attached to an upper member, such as the likeness of a bear's head and face. This arrangement allows a child to leave any desired track on a soft surface such as sand or dirt, and the ornamental design may be used to remind a child of which set of tracks he or she is wearing on the bottom of the sandal.

SUMMARY OF THE INVENTION

Accordingly, it is an important object of the present invention to provide a sandal with a removable sole member that may be easily interchangeable and replaceable with other removable sole members when one sole becomes worn out.

Another important object of the present invention is to provide a sandal for children, having a removable sole that includes any desired graphical design and shape on a bottom portion thereof, such as a bear track, so that a child may leave a footprint resembling any desired animal track or other graphical representation on a soft surface.

Yet another important object of the invention is to provide a sandal for children having a removable sole and a removable ornamental design member on an upper portion thereof, where the graphical design on the underside of the sole (tiger paw, for instance) would logically correspond with the ornamental design member (a tiger's head).

Still another important object of the present invention is to provide a footwear system, where a child may select the type of footprint that he or she would like to leave behind on a soft surface by selecting a particular removable sole to attach to the bottom portion of a sandal.

Another important object of the present invention is to provide a sandal having a removable sole portion, which may be in the shape of a square or circle, or any other desired shape, and which may be used on the bottom of sandals of any size, so that although the particular sandals would have to fit the particular wearer, the removable sole portions universally fit sandals of any size.

Another important object of the present invention is to provide a sandal with a removable sole member that is easy and inexpensive to manufacture, and which overcomes some of the problems associated with other types of footwear having removable soles. These and other objects of the present invention will become apparent with a reading of the following specification, the drawings, and the appended claims.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a bottom view of a sandal having a removable sole with a graphical representation and shape thereon;

FIG. 1A is a bottom view of an alternate embodiment of a sandal having a removable sole with a bear claw design applied thereon;

FIG. 1B is a top view of the sandal shown in FIG. 1A, showing a removable ornamental design member (a bear head) that is attached to an upper portion of the sandal, and which corresponds with the animal tracks on the removable sole (bear claw);

DESCRIPTION OF THE PREFERRED EMBODIMENT

FIG. 1 is a bottom view of a sandal 2 having a removable sole member 4. The removable sole member may include any textured design that may be desirable. In FIG. 1, the design is shown as a smiley face, and the design is formed as a textured surface, so that a wearer walking over a soft surface such as sand or dirt will leave a footprint that mirrors the design on the bottom of the removable sole. FIG. 1A shows an alternate embodiment, which includes an animal footprint, in this case, a bear claw track. The sandal having a removable sole is primarily intended for use by children, so that they may choose which types of tracks they would like to leave in their footprints. A child may select and attach the soles bearing the tracks of a particular animal, such as a rabbit, tiger, bear, deer, or any other desired animal. Alternatively, the removable soles may bear any other written or graphical representation for the same purpose, such as the child's name.

FIG. 1B is a perspective view of the sandal, and showing a preferred embodiment that includes an ornamental design member 22 that may be removably attached to an upper portion 14 of the sandal. The ornamental design member 22 preferably corresponds logically with the textured design on the removable sole. For instance, the ornamental design member shown in FIG. 1B resembles a bear head, and would be attached to the sandal at the same time as the sole shown in FIG. 1A, which includes a bear claw track. Similarly, if a tiger paw were shown on the removable sole tread, then the ornamental design member would resemble the head of a tiger. The ornamental design members may be attached to the upper portion of the sandals by snaps, hook and loop fasteners, or any other suitable means. Although it has been suggested that the ornamental design member logically correspond to the tread on the removable sole, any suitable design may be used for the ornamental design or the removable sole tread, whether they logically correspond or not.

Figure 2:
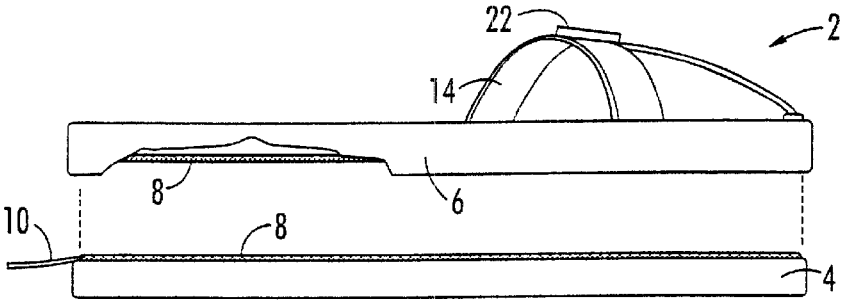
FIG. 2 is a side view of a sandal with a removable sole, attachable by mating hook and loop fasteners shown on the bottom of the upper sole and the top of the removable sole, where the upper sole member includes a lip around a bottom periphery thereof, and a removable sole portion that fits snugly within the indentation defined by the lip.

FIG. 2 shows a side view of the sandal having the removable sole. The upper sole member includes a lip portion 6 which is positioned about a lower periphery thereof. The bottom portion of the upper sole member includes hook and loop fastening material 8, similar to Velcro, which attaches to the mating hook and loop fastening material 8 that is attached to the upper portion of the removable sole member. A tab member 10 is attached to the heel portion of the removable sole, adjacent the hook and loop fastening material, and is received by a break in the lip 12. This tab is used to facilitate removal of the removable sole member, by allowing a wearer to grasp the tab and peel the removable sole from the bottom of the upper sole member. The removable sole member fits snugly within the perimeter of the lip, and is further held in place by the mating hook and loop fastening material. When secured in place, bottom surface of the removable sole is flush with the bottom of the lip. The lip ensures that the removable sole is properly positioned with respect to the sandal, and also prevents the removable sole from sliding out of position.

Figure 3:
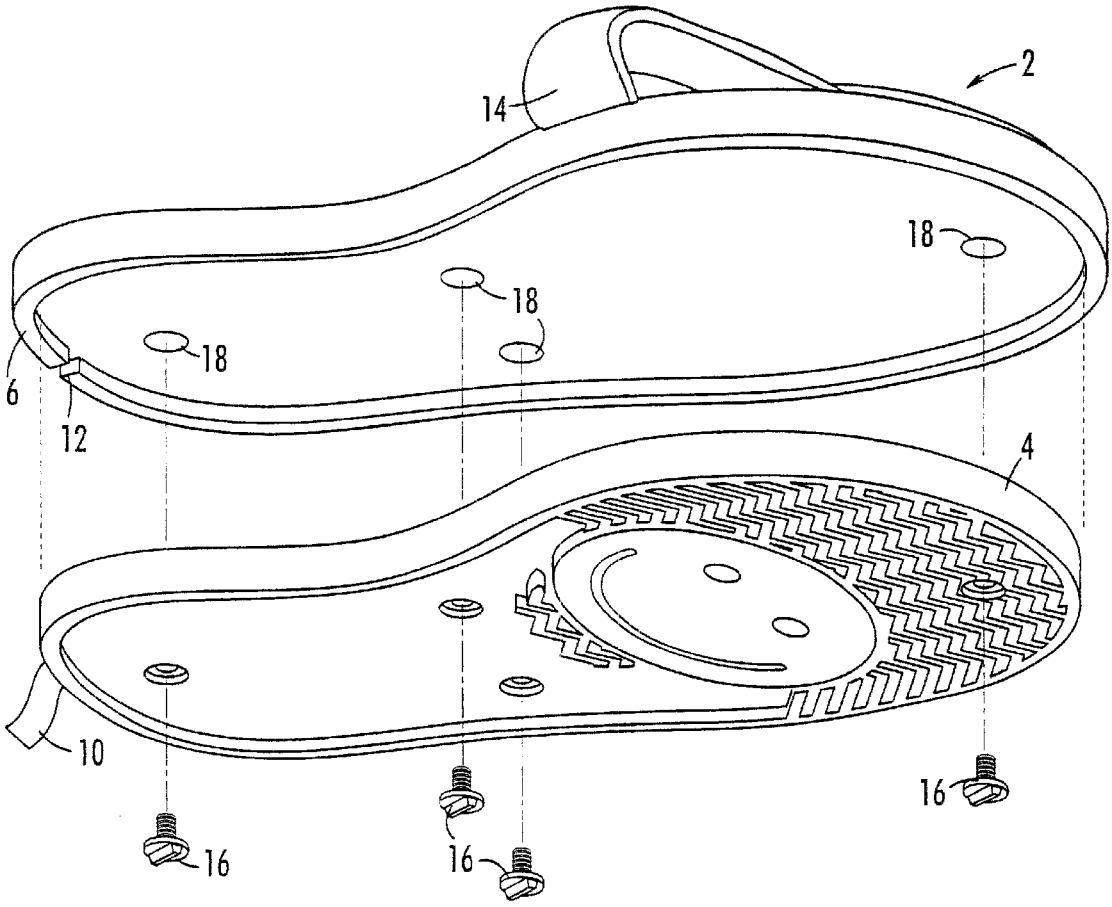
FIG. 3 is a perspective view of the sandal having the removable sole, together with threaded studs that have a gripping portion, which are used to attach the removable sole to the upper sole.

FIG. 3 shows an alternate embodiment of the sandal and removable sole member, where the attachment means include threaded studs 16 having a gripping portion on the head. The studs are passed through the removable sole and screwed into threaded receptacles 18 in the bottom of the upper sole member. A wearer may simply grip the studs and twist them tightly by hand. The studs, when fully secured, are recessed into the removable sole far enough that they do not protrude past the tread portion or bottom surface of the removable sole. This arrangement allows children to easily interchange the soles of the sandals.

Figure 4:
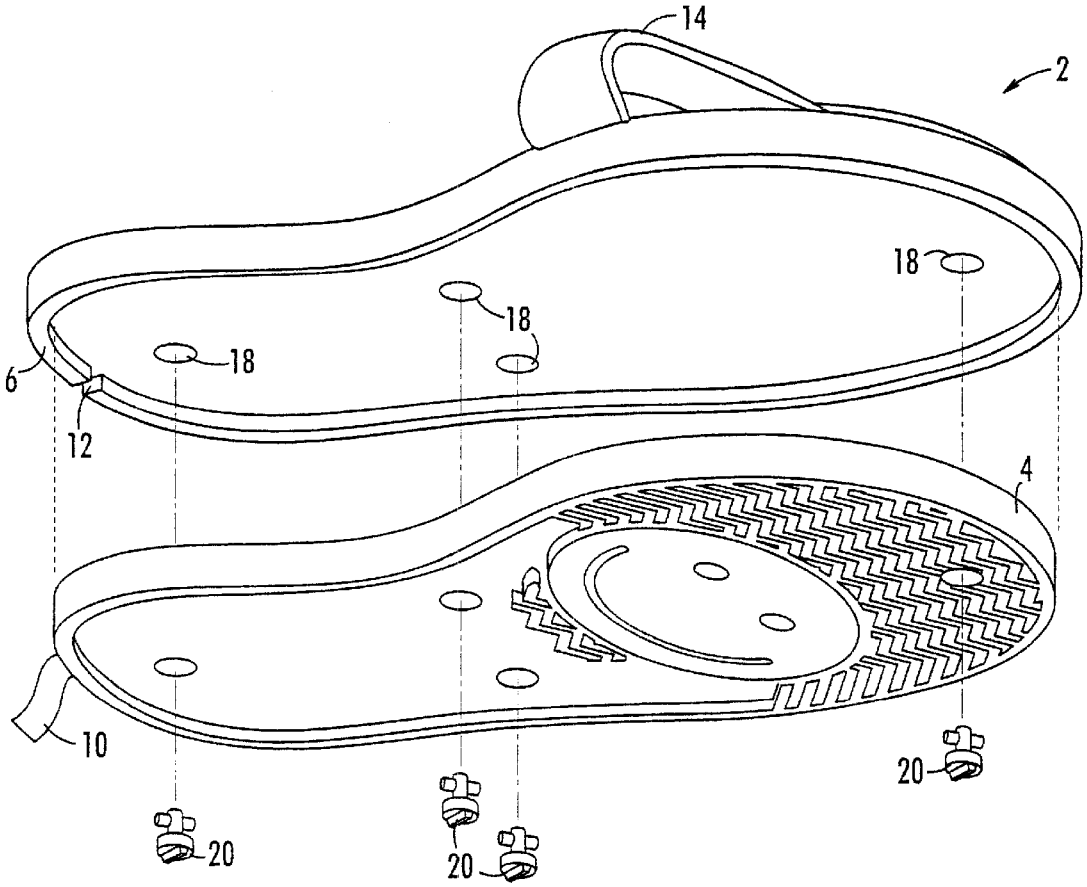
FIG. 4 is a perspective view similar to FIG. 3, where the attachment means include small twist studs having an interlocking groove.

FIG. 4 shows another alternate embodiment, which is similar to FIG. 3 with the exception of the attachment means. In FIG. 4, the attachment means are shown as twist studs 20 having T-bar that fits into an interlocking groove. In this embodiment, the receptacles 18 positioned in the bottom portion of the upper sole member receive the twist stud T-bar within a slit, and a user may secure the twist studs and the removable sole portion thereto by turning the twist studs one quarter turn.

While a preferred embodiment of the invention has been described using specific terms, such description is for illustrative purposes only, and it is to be understood that changes and variations may be made without departing from the spirit or scope of the following claims.

What is claimed is:

1. A sandal system comprising:

a sandal having an upper portion designed to fit the foot of a wearer;

an upper sole member permanently attached to said upper portion of said sandal, said upper sole having a protruding lip member extending about a periphery of said upper sole member on an underside thereof and defining a lower indented portion;

a removable set comprising a plurality of removable ornamental design of different head of animals removably securable to said upper portion, and a plurality of removable lower sole members removably securable within said protruding lip member of said upper sole, each of said removable lower sole member having a desired graphical design on an underside thereof, wherein each graphical design comprises a likeness of an animal track corresponding with a respective different ornamental design, wherein corresponding animal heads and tracks can be changed on a sandal as desired by changing the combination of the ornamental design and the graphical design attached to the sandal;

a tab member attached to each of said removable lower sole member so that when a removable lower sole member is attached to said upper sole member, said tab member is positioned so that a user may grasp said tab member to facilitate removal of said removable lower sole member from said upper sole member; and attachment means for removably securing said removable lower sole member to said upper sole member.

2. The sandal system set forth in claim 1, wherein said upper portion comprises a single strap member that is positioned transversely across a front portion of said upper sole member and attached at either end to said upper sole member, so that said strap member is positioned approximately adjacent and across a wearer's toes.

3. The sandal system set forth in claim 2, further including a toe strap, which is attached to said upper sole member in a position generally forward of said single strap member, and which is also attached to a point on said single strap member, so that said toe strap slides between two toes of a wearer when said sandal is in use.

4. The sandal system set forth in claim 1, wherein said attachment means includes hook and loop fasteners attached to an upper side of said removable sole member, and attached to said lower indented portion of said upper sole member.

5. The sandal system set forth in claim 1, wherein said attachment means includes sunken threaded screw members having a grip top that are placed through holes in said removable sole member and screwed into threaded receptacles in said upper sole member.

6. The sandal system set forth in claim 1, wherein said attachment means includes snap members.

* * * * *